US010454202B2

(12) United States Patent
Shimoji

(10) Patent No.: US 10,454,202 B2
(45) Date of Patent: Oct. 22, 2019

(54) PLUG CONNECTOR WITH A MOVABLE HOUSING INCLUDING A FITTING PORTION INSERTED AND FITTED TO A FITTING PORTION OF A MATING CONNECTOR

(71) Applicant: Japan Aviation Electronics Industry, Limited, Tokyo (JP)

(72) Inventor: Kenichi Shimoji, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 16/164,950

(22) Filed: Oct. 19, 2018

(65) Prior Publication Data

US 2019/0229455 A1 Jul. 25, 2019

(30) Foreign Application Priority Data

Jan. 25, 2018 (JP) ..... 2018-010461

(51) Int. Cl.
*H01R 13/502* (2006.01)
*H01R 13/05* (2006.01)

(52) U.S. Cl.
CPC ..... *H01R 13/502* (2013.01); *H01R 13/05* (2013.01)

(58) Field of Classification Search
CPC ..... H01R 13/501; H01R 13/05; H01R 13/514
USPC ..... 439/701
See application file for complete search history.

(56) References Cited

U.S. PATENT DOCUMENTS 4,722,691 A * 2/1988 Gladd ..... H01R 12/716 439/247
5,306,169 A * 4/1994 Fukushima ..... H01R 12/712 439/248
5,584,709 A * 12/1996 Kiat ..... H01R 12/727 439/79
5,782,644 A * 7/1998 Kiat ..... H01R 12/727 439/79
5,915,979 A * 6/1999 Schell ..... H01R 12/57 439/326
6,039,590 A * 3/2000 Kunishi ..... H01R 13/6315 439/247
6,095,827 A * 8/2000 Dutkowsky ..... H01R 12/57 439/326
6,939,154 B2 * 9/2005 Horikoshi ..... G11B 33/08 439/247

(Continued)

FOREIGN PATENT DOCUMENTS

JP 6192567 B2 9/2017

*Primary Examiner* — Tulsidas C Patel
*Assistant Examiner* — Peter G Leigh
(74) *Attorney, Agent, or Firm* — Collard & Roe, P.C.

(57) ABSTRACT

A connector includes a stationary housing to be mounted to a connection object; a movable housing configured to move relative to the stationary housing; and at least one pair of contacts arranged so as to correspond to each other. Each of the contacts includes: a first held portion fixed to the stationary housing; a second held portion fixed to the movable housing; and an elastic deformation portion configured to couple the first held portion and the second held portion. The elastic deformation portion includes a projecting portion that projects in an approaching direction, which is a direction of approaching the elastic deformation portion of another contact, or in a separating direction, which is a direction opposite to the approaching direction.

9 Claims, 8 Drawing Sheets

(56) References Cited

U.S. PATENT DOCUMENTS

| | | | | |
|---|---|---|---|---|
| 7,186,126 | B2 * | 3/2007 | Umehara | H01R 13/33 439/247 |
| 7,922,539 | B2 * | 4/2011 | Kubo | H01R 13/6315 439/247 |
| 9,048,601 | B2 * | 6/2015 | Kimura | H01R 24/60 |
| 9,331,414 | B2 * | 5/2016 | Doi | H01R 12/65 |
| 9,484,656 | B2 * | 11/2016 | Doi | H01R 12/65 |
| 9,698,508 | B2 * | 7/2017 | Kobayashi | H01R 13/187 |
| 2017/0170588 | A1 * | 6/2017 | Doi | H01R 12/7005 |
| 2017/0338592 | A1 * | 11/2017 | Doi | H01R 13/6315 |

* cited by examiner

PLUG CONNECTOR WITH A MOVABLE HOUSING INCLUDING A FITTING PORTION INSERTED AND FITTED TO A FITTING PORTION OF A MATING CONNECTOR

This application is based upon and claims the benefit of priority from Japanese Patent Application No. 2018-010461 filed on Jan. 25, 2018, the disclosure of which is incorporated herein in its entirety by reference.

BACKGROUND OF THE INVENTION

1. Field of the Invention

This invention relates to a connector.

2. Description of the Related Art

In general, a connector is an electrical component that is fitted to a mating connector and thus electrically connects connection objects mounted to the connector and the mating connector, respectively. Among such connectors, there is known a so-called floating connector capable of shifting a position of a fitting portion of a contact in accordance with a position of a fitting portion of a mating connector when the connector is fitted to the mating connector.

For example, a receptacle connector 1 described in Japanese Patent No. 6192567 includes, as illustrated in FIG. 9, a stationary housing 10, a movable housing 20 arranged on an upper side of the stationary housing 10, and a plurality of receptacle contacts 30 arranged to be arrayed in a right-and-left direction.

The stationary housing 10 is fixed to a board 2 on which a predetermined wiring pattern is formed. The movable housing 20 includes a receptacle-side fitting portion 23 that is mounted to a distal end side of each of the plurality of receptacle contacts 30, and fitted to a plug connector 50.

The receptacle contacts 30 each include two kinds of contacts having different shapes, that is, an upper contact 30*a* and a lower contact 30*b*.

The upper contact 30*a* includes a distal end joining portion 31 connected to the wiring pattern of the board 2 by soldering, a stationary-side press-fitting portion 32 press-fitted into the stationary housing 10, a press-fitting contact portion 37 press-fitted into the movable housing 20, and an upper intermediate portion 38 that couples the stationary-side press-fitting portion 32 and the press-fitting contact portion 37.

The upper intermediate portion 38 is bent at a first bent portion 33*a*, a second bent portion 34*a*, and a third bent portion 35*a*. With this, in the upper intermediate portion 38, a first intermediate portion 33, a second intermediate portion 34, a third intermediate portion 35, and a fourth intermediate portion 36 are formed.

The lower contact 30*b* includes a distal end joining portion 41 connected to the wiring pattern of the board 2 by soldering, a stationary-side press-fitting portion 42 press-fitted into the stationary housing 10, a press-fitting contact portion 47 press-fitted into the movable housing 20, and a lower intermediate portion 48 that couples the stationary-side press-fitting portion 42 and the press-fitting contact portion 47.

The lower intermediate portion 48 is bent at a first bent portion 43*a*, a second bent portion 44*a*, and a third bent portion 45*a*. With this, in the lower intermediate portion 48, a first intermediate portion 43, a second intermediate portion 44, a third intermediate portion 45, and a fourth intermediate portion 46 are formed.

The plug connector 50 includes a plug-side fitting portion 51 that is inserted into and fitted to the receptacle-side fitting portion 23 of the movable housing 20.

When both the connectors 1 and 50 are fitted to each other, the plug-side fitting portion 51 may be displaced relative to the receptacle-side fitting portion 23 in an up-and-down direction or the right-and-left direction. In this case, the upper intermediate portion 38 and the lower intermediate portion 48 of the receptacle connector 1 are elastically deformed, and thus absorb displacement of the plug-side fitting portion 51. In this state, both the connectors 1 and 50 are fitted to each other.

That is, the receptacle connector 1 described in Japanese Patent No. 6192567 is a floating connector capable of shifting a position of the distal end side of each of the plurality of receptacle contacts 30 mounted to the receptacle-side fitting portion 23 in accordance with a position of the plug-side fitting portion 51 when the receptacle connector 1 is fitted to the plug connector 50.

SUMMARY OF THE INVENTION

It is desired that a typical floating connector have a large floating amount. Accordingly, there has been a demand for a floating connector having a larger floating amount within an allowable range in terms of design and an entire size. Herein, the floating amount means an amount by which a position of a fitting portion of a contact can be shifted.

However, in the typical floating connector, as in the receptacle connector 1 described in Japanese Patent No. 6192567, the position of the fitting portion of the contact can be shifted through use of elastic deformation of the contact. Therefore, the floating amount is restricted within a range in which the contact is not plastically deformed, in other words, a range in which the contact can be elastically deformed.

In the receptacle connector 1 described in Japanese Patent No. 6192567, as described above, owing to elastic deformation of the upper intermediate portion 38 and the lower intermediate portion 48, the position of the distal end side of each of the plurality of receptacle contacts 30 can be shifted. Among portions of the upper intermediate portion 38 and the lower intermediate portion 48, particularly portions away from the stationary housing 10 and the movable housing 20 can be freely moved. Thus, it is conceivable that such portions significantly contribute to shifting of the position of the receptacle-side fitting portion 23. That is, it is conceivable that elastic deformation of the third intermediate portions 35 and 45, vicinities of the second bent portions 34*a* and 44*a*, and vicinities of the third bent portions 35*a* and 45*a* significantly contributes to shifting of the position of the distal end side of each of the plurality of contacts 30.

Accordingly, when the floating amount is increased in the receptacle connector 1 described in Japanese Patent No. 6192567, it is conceivable that elongating of the third intermediate portions 35 and 45 in a front-and-rear direction is effective. However, in this case, along with the elongating of the third intermediate portions 35 and 45 in the front-and-rear direction, a length of the receptacle connector 1 in the front-and-rear direction is increased. As a result, there is a risk in that the entire size of the receptacle connector 1 does not satisfy design requirements.

This invention has been made in view of the above-mentioned circumstances, and has an object to provide a connector capable of increasing a floating amount while preventing an increase in entire size.

In order to achieve the above-mentioned object, a connector according to this invention comprises a stationary housing to be mounted to a connection object;

a movable housing configured to move relative to the stationary housing; and at least one pair of contacts arranged so as to correspond to each other, each of the at least one pair of contacts including:

a first held portion fixed to the stationary housing;

a second held portion fixed to the movable housing; and an elastic deformation portion configured to couple the first held portion and the second held portion, the elastic deformation portion of the each of the at least one pair of contacts including a projecting portion that projects in an approaching direction, which is a direction of approaching the elastic deformation portion of another contact of the at least one pair of contacts, or in a separating direction, which is a direction opposite to the approaching direction.

The projecting portion of the each of the at least one pair of contacts may be configured to project in the approaching direction The projecting portions of the at least one pair of contacts may be arranged at different positions in a direction intersecting the approaching direction.

The projecting portions of the at least one pair of contacts may include overlapping portions as viewed in one direction intersecting the approaching direction.

The elastic deformation portion of each of the at least one pair of contacts further may include:

a first extending portion, which extends linearly and has one end continuous with the first held portion, and another end continuous with one end of the projecting portion; and a second extending portion, which has one end continuous with another end of the projecting portion, and extends in one direction intersecting the approaching direction, and the projecting portion may include:

a first bending portion, which has one end continuous with the another end of the first extending portion, and bends in the approaching direction;

a first arm portion, which has one end continuous with another end of the first bending portion, and extends in the approaching direction;

a second bending portion, which has one end continuous with another end of the first arm portion, and bends in one direction intersecting the approaching direction;

a coupling portion, which has one end continuous with another end of the second bending portion, and extends in one direction intersecting the approaching direction;

a third bending portion, which has one end continuous with another end of the coupling portion, and bends in the separating direction;

a second arm portion, which has one end continuous with another end of the third bending portion, and extends in the separating direction; and a fourth bending portion, which bends in one direction intersecting the approaching direction, and has one end continuous with another end of the second arm portion, and another end continuous with the one end of the second extending portion.

The stationary housing may include a mounting surface portion to be mounted to the connection object, and the first extending portion and the second extending portion each may extend in a direction perpendicular to the mounting surface portion.

The stationary housing may include a mounting surface portion to be mounted to the connection object, and the approaching direction and the separating direction may be parallel to the mounting surface portion.

The movable housing may include a fitting portion fitted to a mating connector by being inserted into the mating connector along a direction parallel to the mounting surface portion.

Effect of the Invention

According to this invention, a floating amount can be increased while preventing an increase in entire size.

DESCRIPTION OF THE EMBODIMENTS

Figure 1:
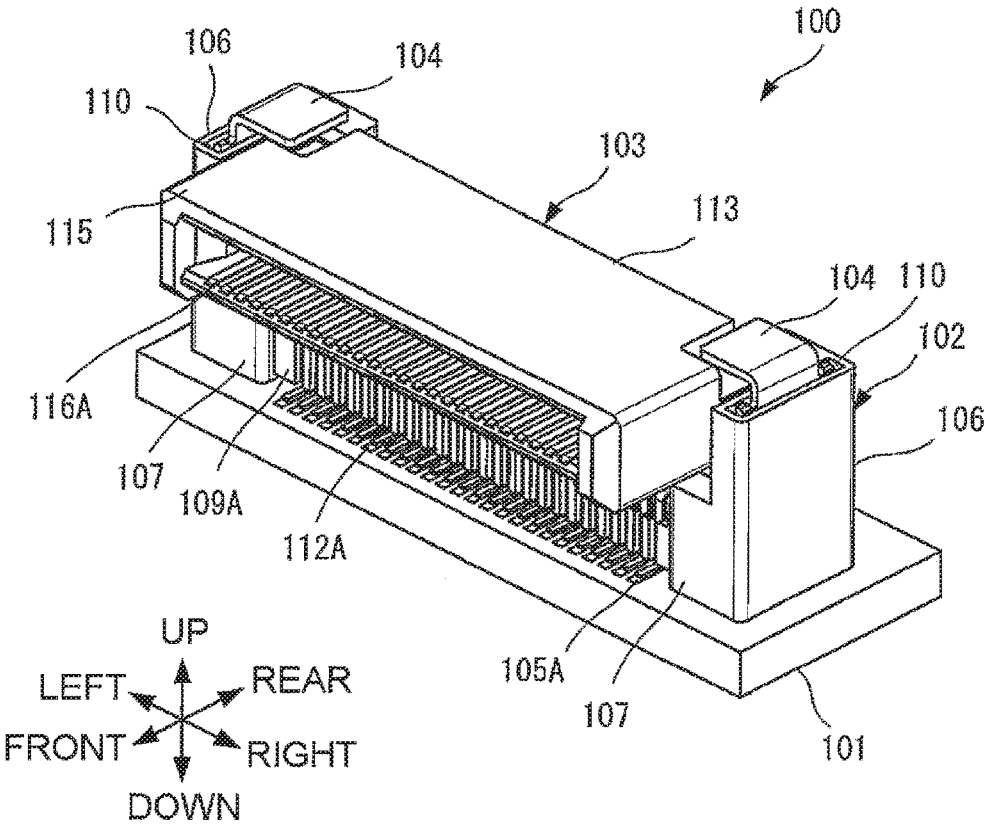
FIG. 1 is a perspective view of a connector according to one embodiment of this invention as viewed from an obliquely front and upper side thereof.

Now, with reference to the drawings, a connector according to one embodiment of this invention is described. The same components are denoted by the same reference symbols in all of the drawings. Further, in the description of the embodiment of this invention and in the drawings, terms "up", "down", "front", "rear", "right", and "left" are used. Those terms are used for description of directions and are not intended to limit this invention.

Figure 2:
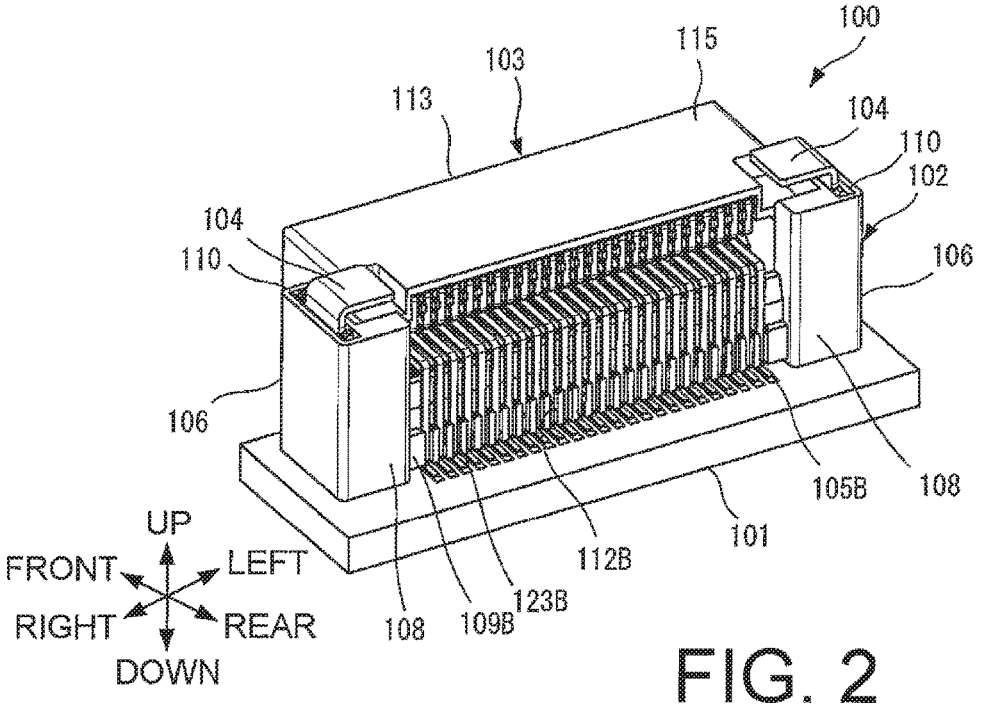
FIG. 2 is a perspective view of the connector according to this embodiment as viewed from an obliquely rear and upper side thereof.
Figure 3:
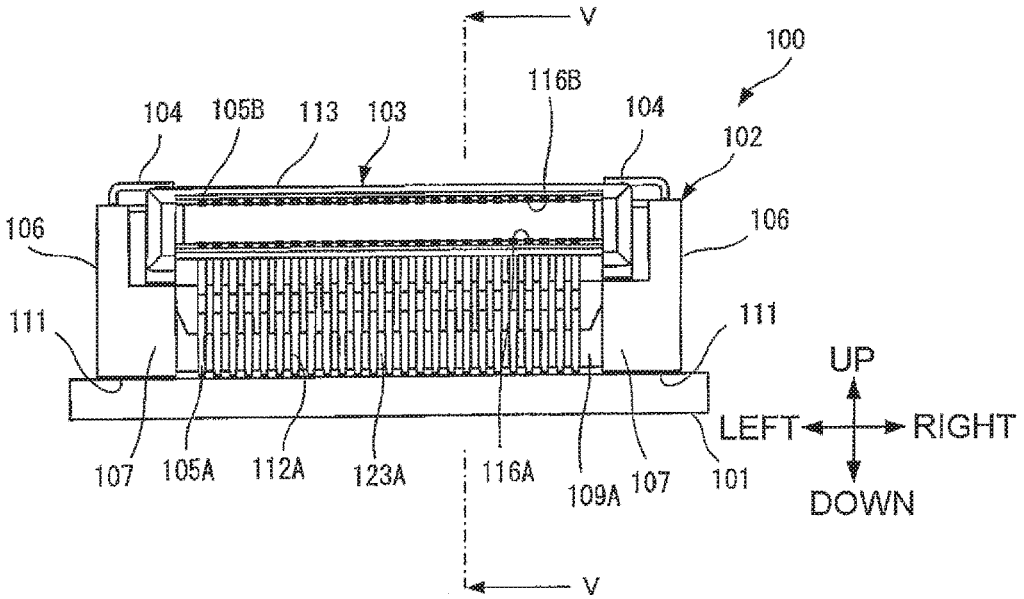
FIG. 3 is a front view of the connector according to this embodiment.

A connector 100 according to one embodiment of this invention is mounted to a board 101 as illustrated in FIG. 1, which is a perspective view of the connector 100 as viewed from an obliquely front and upper side thereof, FIG. 2, which is a perspective view of the connector 100 as viewed from an obliquely rear and upper side thereof, and FIG. 3, which is a front view of the connector 100.

The connector 100 is fitted to a mating connector (not shown) by inserting the mating connector into the connector 100 rearward. Thus, wiring provided on the board 101 is electrically and mutually connected to, for example, wiring on a cable or a board to which the mating connector is mounted. Further, fitting between the connector 100 and the mating connector is canceled by pulling out the mating connector forward.

As illustrated in FIG. 1 to FIG. 3, the connector 100 includes a stationary housing 102, a movable housing 103, right and left fixtures 104, and a plurality of pairs of a first contact 105A and a second contact 105B.

The stationary housing 102 is a member configured to hold the plurality of pairs of the first contact 105A and the second contact 105B, and is mounted to the board 101. The stationary housing 102 is integrally formed of, for example, resin. The board 101 is an example of a connection object to which the stationary housing 102 is mounted. The stationary housing 102 may be mounted to a connection object other than the board 101.

Figure 4:
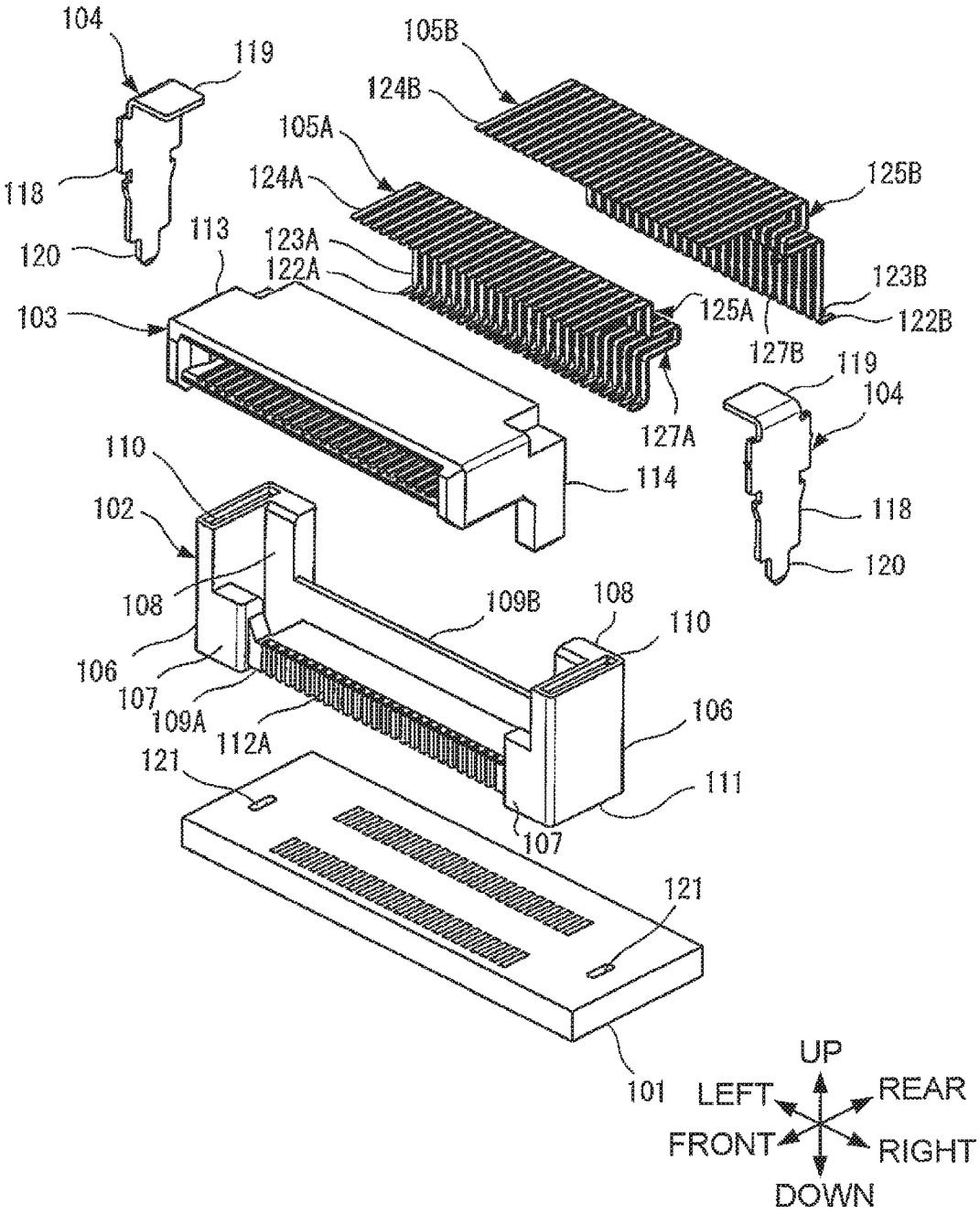
FIG. 4 is an exploded perspective view of the connector according to this embodiment.

Specifically, as illustrated in FIG. 4 being an exploded perspective view of the connector 100, the stationary housing 102 mainly includes fixed portions 106 formed on right and left sides of the connector, front extending portions 107 formed on the right and left sides, rear extending portions 108 formed on the right and left sides, and plate-shaped portions 109A and 109B formed on front and rear sides of the connector.

The fixed portions 106 are each a portion having a rectangular parallelepiped shape and extending substantially in an up-and-down direction. The fixed portions 106 each have a through-hole 110 penetrating therethrough in the up-and-down direction.

The right-side and left-side front extending portions 107 are each a portion having substantially a rectangular parallelepiped shape. The right-side and left-side front extending portions 107 are continuous with the right-side and left-side fixed portions 106, respectively.

The left-side front extending portion 107 extends rightward from the left-side fixed portion 106. A front surface of the left-side front extending portion 107 is formed flush with a front surface of the left-side fixed portion 106. Further, the right-side front extending portion 107 extends leftward from the right-side fixed portion 106. A front surface of the right-side front extending portion 107 is formed flush with a front surface of the right-side fixed portion 106.

A height of each of the front extending portions 107 (length in the up-and-down direction in this embodiment) is lower than a height of each of the fixed portions 106. In this embodiment, the height of each of the front extending portions 107 is about a half of the height of each of the fixed portions 106.

The right-side and left-side rear extending portions 108 are each a portion having substantially a rectangular parallelepiped shape. The right-side and left-side rear extending portions 108 are continuous with the right-side and left-side fixed portions 106, respectively.

The left-side rear extending portion 108 extends rightward from the left-side fixed portion 106. A rear surface of the left-side rear extending portion 108 is formed flush with a rear surface of the left-side fixed portion 106. Further, the right-side rear extending portion 108 extends leftward from the right-side fixed portion 106. A rear surface of the right-side rear extending portion 108 is formed flush with a rear surface of the right-side fixed portion 106.

A height of each of the rear extending portions 108 is equal to the height of each of the fixed portions 106.

In this case, the left-side front extending portion 107 and the left-side rear extending portion 108 extend rightward from the left-side fixed portion 106 by substantially the same length with a predetermined interval in a front-and-rear direction. Similarly, the right-side front extending portion 107 and the right-side rear extending portion 108 extend leftward from the right-side fixed portion 106 by substantially the same length with a predetermined interval in the front-and-rear direction.

With this configuration, a clearance extending in the up-and-down direction is defined between the left-side front extending portion 107 and the left-side rear extending portion 108. A clearance extending in the up-and-down direction is defined also between the right-side front extending portion 107 and the right-side rear extending portion 108. The clearance between the left-side front extending portion 107 and the left-side rear extending portion 108, and the clearance between the right-side front extending portion 107 and the right-side rear extending portion 108 are defined at substantially the same positions with each other in the front-and-rear direction. With this structure, the left-side front extending portion 107, the left-side rear extending portion 108, the right-side front extending portion 107, and the right-side rear extending portion 108 function as guides configured to restrict movement of the movable housing 103 as described later in detail.

Further, lower surfaces of the fixed portions 106, the front extending portions 107, and the rear extending portions 108 are formed flush with each other. In this embodiment, a region forming the lower surfaces of those portions 106, 107, and 108 is a mounting surface portion 111 to be mounted to the board 101. The mounting surface portion 111 of the stationary housing 102 in this embodiment forms a flat surface extending in parallel to the front-and-rear direction and a right-and-left direction.

The front-side and rear-side plate-shaped portions 109A and 109B are portions configured to couple the right-side and left-side front extending portions 107 and the right-side and left-side rear extending portions 108. The plate-shaped portions 109A and 109B are configured to hold, as first holding portions, the plurality of pairs of the first contact 105A and the second contact 105B. That is, the front-side plate-shaped portion 109A is configured to couple the right-side and left-side front extending portions 107, and hold the plurality of first contacts 105A. Further, the rear-side plate-shaped portion 109B is configured to couple the right-side and left-side rear extending portions 108, and hold the plurality of second contacts 105B.

More specifically, a plurality of first groove portions 112A extending in the up-and-down direction are formed in a front surface of the front-side plate-shaped portion 109A to be arrayed in the right-and-left direction. The first groove portions 112A of the front-side plate-shaped portion 109A are each formed to be open to an upper side and a lower side of the connector. The first groove portions 112A of the front-side plate-shaped portion 109A sandwich the first contacts 105A while applying forces, to thereby hold the plurality of first contacts 105A as the front-side first holding portions.

Similarly to the front surface of the front-side plate-shaped portion 109A, in a rear surface of the rear-side plate-shaped portion 109B, a plurality of first groove portions 112B extending in the up-and-down direction and being opened to the upper side and the lower side are formed to be arrayed in the right-and-left direction. The first groove portions 112B of the rear-side plate-shaped portion 109B are configured to sandwich the second contacts 105B while applying forces, to thereby hold the plurality of second contacts 105B as the rear-side first holding portions. Each of the first groove portions 112B of the rear-side plate-shaped portion 109B is formed at the same position so as to correspond to each of the first groove portions 112A of the front-side plate-shaped portion 109A in the right-and-left direction.

Figure 5:
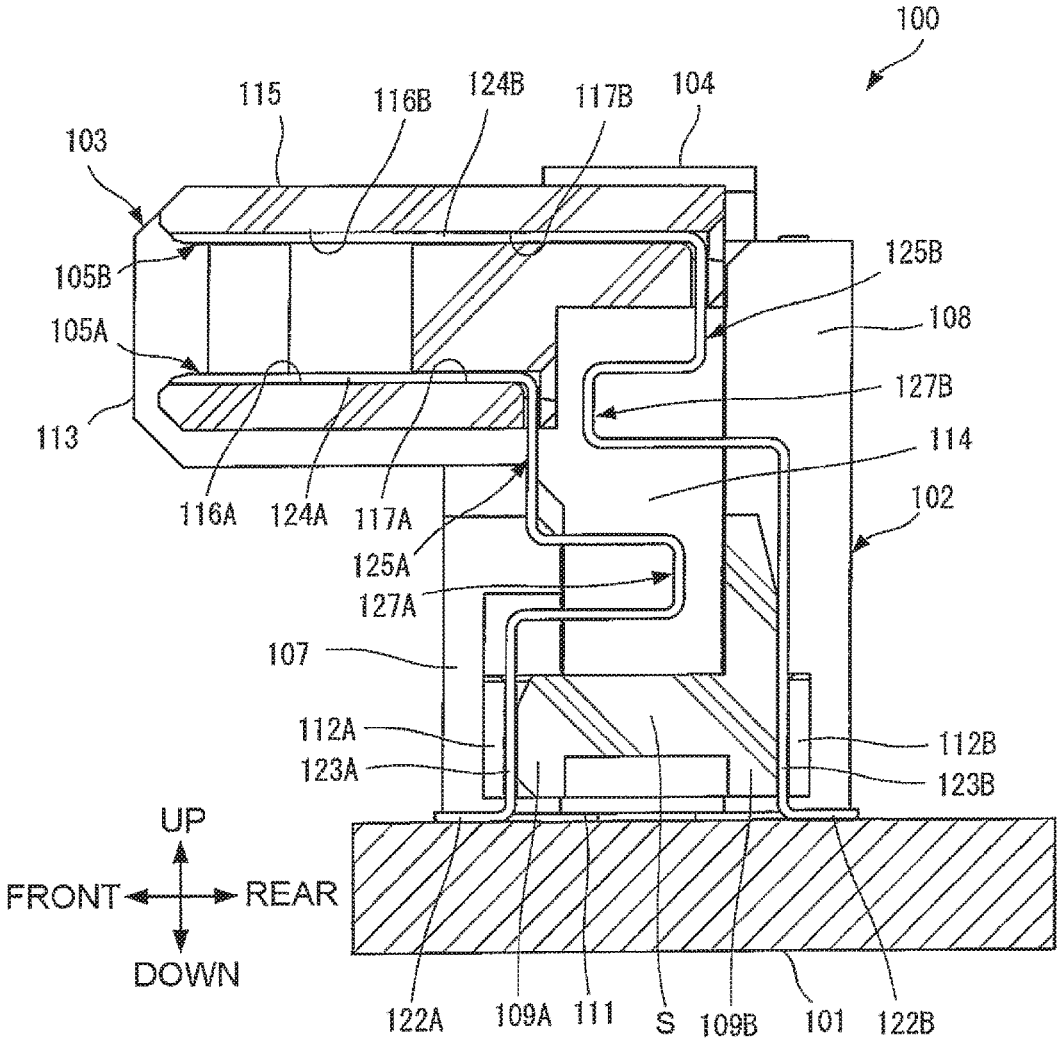
FIG. 5 is a side sectional view taken along the line V-V of FIG. 3.

As illustrated in FIG. 5 being a side sectional view of the connector 100, the front-side and rear-side plate-shaped portions 109A and 109B in this embodiment are coupled to each other by an appropriate reinforcement portion S inside the stationary housing 102. The reinforcement portion S may be omitted.

The movable housing 103 is a member that moves relative to the stationary housing 102, and is configured to hold the plurality of pairs of the first contact 105A and the second contact 105B. The movable housing 103 is integrally formed of, for example, resin. In this embodiment, a position of the movable housing 103 can be shifted relative to the stationary housing 102 in the up-and-down direction and the right-and-left direction within a predetermined range. The movable housing 103 may be slightly movable relative to the stationary housing 102 also in the front-and-rear direction.

More specifically, as illustrated in, for example, FIG. 1 to FIG. 5, the movable housing 103 includes a tubular portion 113 and right and left guided portions 114. The tubular portion 113 extends in the front-and-rear direction. The guided portions 114 each have a substantially rectangular parallelepiped shape, and extend downward from a left rear portion and a right rear portion of a lower surface of the tubular portion 113, respectively.

The tubular portion 113 is a portion having a substantially rectangular parallelepiped shape and extending in the front-and-rear direction, and has such a shape that right-side and left-side rear upper portions of the tubular portion 113 are cut out. A portion of the tubular portion 113 from the front side up to a predetermined fitting length is hollow, whereas a rear portion of the tubular portion 113 with respect to the fitting length is substantially solid. As illustrated in FIG. 3 and FIG. 5, the tubular portion 113 includes a fitting portion 115, second groove portions 116A and 116B, and hole portions 117A and 117B. The second groove portions 116A and the second groove portions 116B are formed so as to correspond to each other in the up-and-down direction, and the hole portions 117A and the hole portions 117B are formed so as to correspond to each other in the up-and-down direction.

The fitting portion 115 is a portion to be fitted to the mating connector. In this embodiment, the fitting portion 115 corresponds to a hollow portion of the tubular portion 113 extending rearward from a front end. The hollow portion of the tubular portion 113 has a substantially rectangular shape as viewed from the front side. Further, the hollow portion of the tubular portion 113 is formed in the front-and-rear direction within a range from the front end to the predetermined fitting length.

The upper-side and lower-side second groove portions 116A and 116B and the upper-side and lower-side hole portions 117A and 117B are a region configured to hold, as second holding portions, the plurality of pairs of the first contact 105A and the second contact 105B.

More specifically, in an upper surface among inner surfaces forming the hollow portion of the tubular portion 113, a plurality of second groove portions 116B extending in the front-and-rear direction are formed to be arrayed in the right-and-left direction. The upper-side second groove portions 116B are each formed to be open to the front side. Further, in a solid portion of the tubular portion 113, the upper-side hole portions 117B are formed to penetrate through the solid portion in the front-and-rear direction by extending rearward through communication with the upper-side second groove portions 116B. The upper-side second groove portions 116B sandwich the second contacts 105B while applying forces. The upper-side hole portions 117B hold the second contacts 105B while surrounding the second contacts 105B. With this, a plurality of pairs of the upper-side second groove portion 116B and the hole portion 117B, which are formed to communicate with each other, hold the plurality of second contacts 105B as the upper-side second holding portions.

On a rear surface of the tubular portion 113 and on portions on which the plurality of second contacts 105B are to be arranged, a plurality of projections are formed as appropriate to project rearward. The plurality of projections are configured to prevent the plurality of second contacts 105B from moving in the right-and-left direction and coming into contact with each other.

Similarly to the upper surface, in a lower surface among the inner surfaces forming the hollow portion of the tubular portion 113, a plurality of second groove portions 116A extending in the front-and-rear direction are formed to be arrayed in the right-and-left direction. The lower-side second groove portions 116A are each formed to be open to the front side. Further, in a solid portion of the tubular portion 113, the lower-side hole portions 117A are formed to penetrate through the solid portion in the front-and-rear direction by extending rearward through communication with the lower-side second groove portions 116A. The lower-side second groove portions 116A sandwich the first contacts 105A while applying forces. The lower-side hole portions 117A hold the first contacts 105A while surrounding the first contacts 105A. With this, a plurality of pairs of the lower-side second groove portion 116A and the hole portion 117A, which are formed to communicate with each other, hold the plurality of first contacts 105A as the lower-side second holding portions.

The plurality of pairs of the upper-side second groove portion 116B and the upper-side hole portion 117B are formed at positions so as to correspond to a plurality of pairs of the lower-side second groove portion 116A and the lower-side hole portion 117A in the right-and-left direction so as so as to correspond thereto. Further, the plurality of pairs of the upper-side second groove portion 116B and the upper-side hole portion 117B are also formed at positions so as to correspond to the plurality of first groove portions 112B of the rear-side plate-shaped portion 109B in the right-and-left direction so as so as to correspond thereto. As described above, the first groove portions 112B of the rear-side plate-shaped portion 109B are formed at the positions so as to correspond to the first groove portions 112A of the front-side plate-shaped portion 109A in the right-and-left direction so as so as to correspond thereto. Therefore, the plurality of pairs of the lower-side second groove portion 116A and the lower-side hole portion 117A are formed at positions so as to correspond to the plurality of first groove portions 112A of the front-side plate-shaped portion 109A in the right-and-left direction so as so as to correspond thereto.

Further, the upper-side and lower-side second groove portions 116A and 116B have the same length in the front-and-rear direction, and are formed at positions so as to correspond to each other in the front-and-rear direction. As described above, front ends of the upper-side and lower-side hole portions 117A and 117B communicate with rear ends of the upper-side and lower-side second groove portions 116A and 116B, which are formed at the positions so as to correspond to the upper-side and lower-side hole portions 117A and 117B in the front-and-rear direction. The upper-side and lower-side hole portions 117A and 117B have different lengths extending in the front-and-rear direction, and the upper-side hole portion 117B is longer than the lower-side hole portion 117A. Accordingly, the rear ends of the upper-side hole portions 117B are located rearward of the rear ends of the lower-side hole portions 117A.

A left surface of the left-side guided portion 114 is formed flush with an outer left surface of the tubular portion 113. A right surface of the right-side guided portion 114 is formed flush with an outer right surface of the tubular portion 113.

The left-side guided portion 114 is fitted between the left-side front extending portion 107 and the left-side rear extending portion 108, and the right-side guided portion 114 is fitted between the right-side front extending portion 107 and the right-side rear extending portion 108. With this, movement of the right-side and left-side guided portions 114 in the front-and-rear direction is restricted by the right-side and left-side front extending portions 107 and the right-side and left-side rear extending portions 108.

Further, the right-side and left-side guided portions 114 are fitted between the right-side and left-side fixed portions 106 with clearances with the right-side and left-side fixed portions 106. With this, movement of the right-side and left-side guided portions 114 in the right-and-left direction is restricted by the right-side and left-side fixed portions 106.

The fixtures 104 are each a tool configured to fix the connector 100 to the board 101. Typically, the fixtures 104 are made of metal. The fixtures 104 each have an L-shape as viewed from the front side, and includes an insertion arrangement portion 118, a stopping portion 119, and a board fixing portion 120.

The insertion arrangement portion 118 is a portion to be arranged under a state of being inserted in the through-hole 110 of the fixed portion 106 of the stationary housing 102. The insertion arrangement portion 118 is held in the fixed portion 106 while applying a force, and a position of the insertion arrangement portion 118 with respect to the stationary housing 102 is fixed.

The stopping portion 119 is a portion extending from an upper end of the insertion arrangement portion 118 to the upper side of the movable housing 103. Specifically, the stopping portion 119 of the left-side fixture 104 extends rightward from the upper end of the insertion arrangement portion 118, and at least part of the stopping portion 119 is positioned above the cutout portion of the tubular portion 113 of the movable housing 103. The stopping portion 119 of the right-side fixture 104 extends leftward from the upper end of the insertion arrangement portion 118, and at least part of the stopping portion 119 is positioned above the cutout portion of the tubular portion 113 of the movable housing 103. With the stopping portion 119 described above, upward movement of the movable housing 103 relative to the stationary housing 102 is restricted.

The board fixing portion 120 is a portion to be fixed to the board 101. In this embodiment, the board fixing portion 120 extends from a lower end of the insertion arrangement portion 118 to the lower side. For example, the board fixing portion 120 is fixed to the board 101 by soldering after being inserted from one surface of the board 101 into a board hole 121 formed in the board 101 in advance. With this, the board fixing portion 120 is engaged with the board 101 so that the fixture 104 is fixed so as not to be disengaged from the board 101. As a result, the connector 100 can be fixed to the board 101 through use of the fixture 104.

The fixture 104 may be made of a material other than metal, for example, resin. A method of fixing the board fixing portion 120 to the board 101 is not limited to the soldering described above. An appropriate method, such as bonding using an adhesive, may be adopted.

The plurality of pairs of the first contact 105A and the second contact 105B are each a conductive elongated member, and are each produced by, for example, appropriately bending or curving a wire-like thin metal bar punched out from a metal plate.

As described above, the pair of the first contact 105A and the second contact 105B are held by the first groove portions 112A and 112B, the second groove portions 116A and 116B, and the hole portions 117A and 117B, and are arranged apart from each other in a common plane parallel to the up-and-down direction and the front-and-rear direction. Thus, in this embodiment, the pair of the first contact 105A and the second contact 105B are arranged in the common plane, to thereby be opposed to each other. Further, the plurality of pairs of the first contact 105A and the second contact 105B are arrayed in a pitch direction. The pitch direction corresponds to the right-and-left direction in this embodiment.

It is only required that the connector 100 include at least a pair of the first contact 105A and the second contact 105B. Further, arrangement of the pair of the first contact 105A and the second contact 105B is not limited in the common plane parallel to the up-and-down direction and the front-and-rear direction. It is only required that the pair of the first contact 105A and the second contact 105B have a predetermined positional relationship and be opposed to each other.

Figure 6:
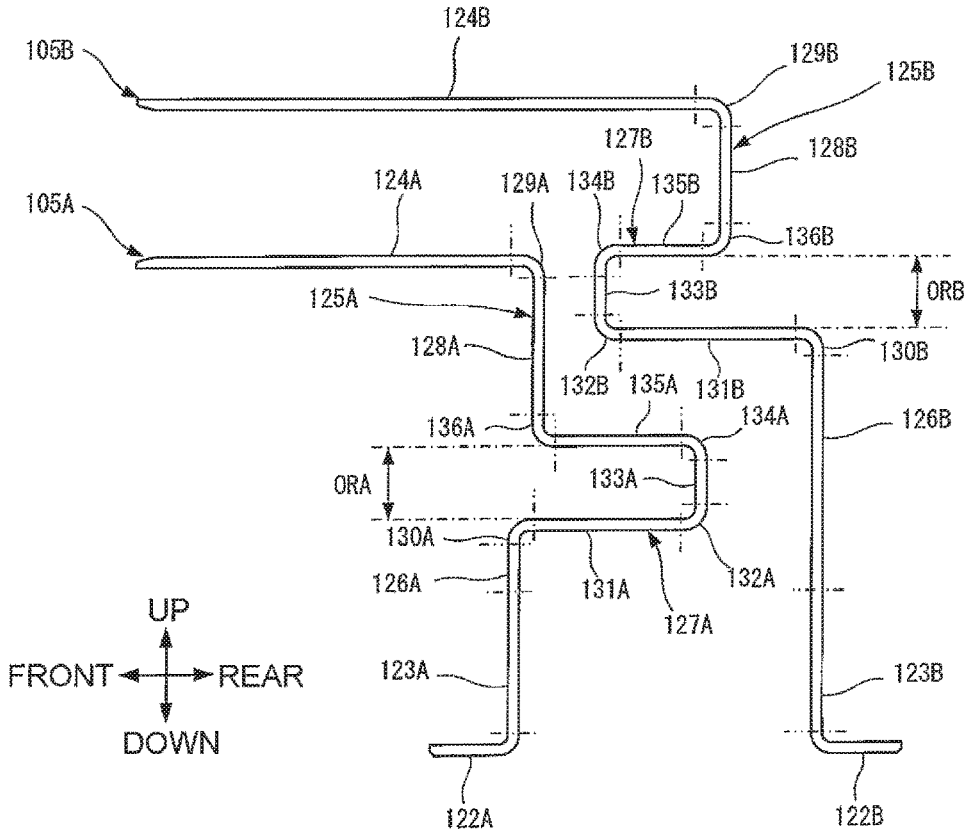
FIG. 6 is an enlarged side view of a pair of contacts of the connector according to this embodiment.

As illustrated in FIG. 5 and FIG. 6, the first contact 105A includes a board connection portion 122A, a first held portion 123A, a second held portion 124A, and an elastic deformation portion 125A. Further, the second contact 105B includes a board connection portion 122B, a first held portion 123B, a second held portion 124B, and an elastic deformation portion 125B.

Here, FIG. 6 is a side view of a pair of the first contact 105A and the second contact 105B of the connector 100 according to this embodiment. The two-dot chain lines of FIG. 6 are imaginary lines each indicating a boundary between the respective portions.

As described above, the pair of the first contact 105A and the second contact 105B include the corresponding portions 122A and 122B, the corresponding portions 123A and 123B, the corresponding portions 124A and 124B, and the corresponding portions 125A and 125B. However, as is apparent from FIG. 5 and FIG. 6, the pair of the first contact 105A and the second contact 105B have different shapes.

The board connection portions 122A and 122B are each a portion to be connected to the board 101 by an appropriate method such as soldering. The board connection portions 122A and 122B in this embodiment each include a portion extending in parallel to the mounting surface portion 111, and a portion bending upward from one end of the extending portion.

Specifically, the board connection portion 122A of the first contact 105A includes a portion extending in the front-and-rear direction, and a portion bending upward from a rear end of the extending portion. The board connection portion 122B of the second contact 105B includes a portion extending in the front-and-rear direction, and a portion bending upward from a front end of the extending portion.

The first held portions 123A and 123B are each a portion to be fixed to the stationary housing 102.

The first held portions 123A and 123B in this embodiment are continuous with upper ends of the board connection portions 122A and 122B, respectively, and extend upward linearly.

The first held portion 123A of the first contact 105A is fixed to the stationary housing 102 by being held by the first groove portion 112A of the front-side plate-shaped portion 109A. Further, the first held portion 123B of the second contact 105B is fixed to the stationary housing 102 by being held by the first groove portion 112B of the rear-side plate-shaped portion 109B. Therefore, the first held portion 123A and the first held portion 123B each are arranged so as to correspond to the positions in the right-and-left direction in the front-and-rear direction.

Further, the first held portion 123A and the first held portion 123B in this embodiment have substantially the same length and the same positions in the up-and-down direction.

The second held portions 124A and 124B are each a portion to be fixed to the movable housing 103. The second held portions 124A and 124B in this embodiment extend linearly in the front-and-rear direction.

The second held portion 124A of the first contact 105A is fixed to the movable housing 103 by being held by the lower-side second groove portion 116A and the lower-side hole portion 117A that communicate with each other. The second held portion 124B of the second contact 105B is fixed to the movable housing 103 by being held by the upper-side second groove portion 116B and the upper-side hole portion 117B that communicate with each other. Therefore, the second held portion 124B and the second held portion 124A each are arranged so as to correspond to the positions in the right-and-left direction in the up-and-down direction.

In addition, front ends of the second held portion 124A and the second held portion 124B in this embodiment are arranged at substantially the same positions in the front-and-rear direction, and the second held portion 124A and the second held portion 124B have different lengths extending in the front-and-rear direction. The length of the second held portion 124B in the front-and-rear direction is larger than that of the second held portion 124A in the front-and-rear direction. Therefore, a rear end of the second held portion 124B is located rearward of a rear end of the second held portion 124A.

As illustrated in FIG. 5 and FIG. 6, the elastic deformation portion 125A of the first contact 105A is a portion configured to couple the first held portion 123A and the second held portion 124A. The elastic deformation portion 125A includes a first extending portion 126A, a projecting portion 127A, a second extending portion 128A, and an inflecting portion 129A.

Further, the elastic deformation portion 125B of the second contact 105B is a portion configured to couple the first held portion 123B and the second held portion 124B. The elastic deformation portion 125B includes a first extending portion 126B, a projecting portion 127B, a second extending portion 128B, and an inflecting portion 129B.

As described above, the elastic deformation portion 125A and the elastic deformation portion 125B include the corresponding portions 126A and 126B, the corresponding portions 127A and 127B, the corresponding portions 128A and 128B, and the corresponding portions 129A and 129B. However, as is apparent from FIG. 5 and FIG. 6, the elastic deformation portion 125A and the elastic deformation portion 125B have different shapes.

The first extending portions 126A and 126B are each a portion having one end that is continuous with the first held portion 123A or the first held portion 123B and extends linearly, and having another end continuous with one end of the projecting portion 127A or the projecting portion 127B. An extending direction of each of the first extending portions 126A and 126B is perpendicular to the mounting surface portion 111, and corresponds to an upward direction in this embodiment.

Specifically, the first extending portion 126A of the first contact 105A has a lower end that is continuous with an upper end of the first held portion 123A and extends upward linearly, and has an upper end continuous with a lower end of the projecting portion 127A. The first extending portion 126B of the second contact 105B has a lower end that is continuous with an upper end of the first held portion 123B and extends upward linearly, and has an upper end continuous with a lower end of the projecting portion 127B.

The first extending portion 126A and the first extending portion 126B have different lengths extending linearly. In this embodiment, the first extending portion 126B is longer than the first extending portion 126A. The upper end of the first extending portion 126B is located above the upper end of the projecting portion 127A.

The projecting portion 127A is a portion formed between the first extending portion 126A and the second extending portion 128A, and the projecting portion 127B is a portion formed between the first extending portion 126B and the second extending portion 128B. Each of the projecting portions 127A and 127B has a rectangular shape, and projects in an approaching direction.

Here, the approaching direction refers to a direction in which one of the pair of the first contact 105A and the second contact 105B approaches the elastic deformation portion 125A or the elastic deformation portion 125B of another one of the pair of the first contact 105A and the second contact 105B. Further, a direction opposite to the approaching direction is referred to as a separating direction.

That is, the projecting portion 127A of the first contact 105A projects in a direction of approaching the elastic deformation portion 125B of the second contact 105B being another contact. Further, the projecting portion 127B of the second contact 105B projects in a direction of approaching the elastic deformation portion 125A of the first contact 105A being another contact.

Therefore, in this embodiment, the approaching direction of the projecting portion 127A of the first contact 105A corresponds to a rearward direction, whereas the approaching direction of the projecting portion 127B of the second contact 105B corresponds to a forward direction. Thus, the approaching direction in this embodiment is parallel to the mounting surface portion 111.

A projecting amount of each of the projecting portion 127A and the projecting portion 127B in the approaching direction may be changed as appropriate. In this embodiment, the projecting portion 127A and the projecting portion 127B include overlapping portions as viewed from above.

Specifically, the projecting portion 127A of the first contact 105A includes a first bending portion 130A, a first arm portion 131A, a second bending portion 132A, a coupling portion 133A, a third bending portion 134A, a second arm portion 135A, and a fourth bending portion 136A. Further, the projecting portion 127B of the second contact 105B includes a first bending portion 130B, a first arm portion 131B, a second bending portion 132B, a coupling portion 133B, a third bending portion 134B, a second arm portion 135B, and a fourth bending portion 136B.

As described above, the projecting portion 127A and the projecting portion 127B include the corresponding portions 130A and 130B, the corresponding portions 131A and 131B, the corresponding portions 132A and 132B, the corresponding portions 133A and 133B, the corresponding portions 134A and 134B, the corresponding portions 135A and 135B, and the corresponding portions 136A and 136B.

The first bending portions 130A and 130B are each a portion that has one end continuous with another end of the first extending portion 126A or the first extending portion 126B, and bends in the approaching direction.

More specifically, the first bending portion 130A of the first contact 105A has a lower end continuous with the upper end of the first extending portion 126A, and bends rearward. The first bending portion 130B of the second contact 105B has a lower end continuous with the upper end of the first extending portion 126B, and bends forward.

The first arm portions 131A and 131B are each a portion that has one end continuous with another end of the first bending portion 130A or the first bending portion 130B and extends in the approaching direction.

More specifically, the first arm portion 131A of the first contact 105A has a front end continuous with the rear end of the first bending portion 130A, and extends rearward linearly. The first arm portion 131B of the second contact 105B has a rear end continuous with the front end of the first bending portion 130B, and extends forward linearly.

The second bending portions 132A and 132B are each a portion that has one end continuous with another end of the first arm portion 131A or the first arm portion 131B, and bends in one direction intersecting the approaching direction.

More specifically, the second bending portion 132A of the first contact 105A has a front end continuous with the rear end of the first arm portion 131A, and bends upward. The second bending portion 132B of the second contact 105B has a rear end continuous with the front end of the first arm portion 131B, and bends upward. The upward direction in this embodiment is an example of one direction intersecting the approaching direction.

The coupling portions 133A and 133B are each a portion that has one end continuous with another end of the second bending portion 132A or the second bending portion 132B, and extends in one direction intersecting the approaching direction.

More specifically, the coupling portion 133A of the first contact 105A has a lower end continuous with the upper end of the second bending portion 132A, and extends upward. The coupling portion 133B of the second contact 105B has a lower end continuous with the upper end of the second bending portion 132B, and extends upward.

The third bending portions 134A and 134B are each a portion that has one end continuous with another end of the coupling portion 133A or the coupling portion 133B, and bends in the separating direction.

More specifically, the third bending portion 134A of the first contact 105A has a lower end continuous with the upper end of the coupling portion 133A, and bends forward. The third bending portion 134B of the second contact 105B has a lower end continuous with the upper end of the coupling portion 133B, and bends rearward.

The second arm portions 135A and 135B are each a portion that has one end continuous with another end of the third bending portion 134A or the third bending portion 134B and extends in the separating direction.

More specifically, the second arm portion 135A of the first contact 105A has a rear end continuous with the front end of the third bending portion 134A, and extends forward. The second arm portion 135B of the second contact 105B has a front end continuous with the rear end of the third bending portion 134B, and extends rearward.

The fourth bending portions 136A and 136B are each a portion that bends in one direction intersecting the approaching direction, and has one end continuous with another end of the second arm portion 135A or the second arm portion 135B, and another end continuous with one end of the second extending portion 128A or the second extending portion 128B.

More specifically, the fourth bending portion 136A of the first contact 105A bends upward, and has a rear end continuous with the front end of the second arm portion 135A, and an upper end continuous with the lower end of the second extending portion 128A. The fourth bending portion 136B of the second contact 105B bends upward, and has a front end continuous with the rear end of the second arm portion 135B, and an upper end continuous with the lower end of the second extending portion 128B.

The second extending portions 128A and 128B are each a portion that has one end continuous with another end of the projecting portion 127A or the projecting portion 127B, and extends in one direction intersecting the approaching direction.

Specifically, the second extending portion 128A of the first contact 105A has a lower end continuous with the projecting portion 127A, and extends linearly in one direction intersecting the approaching direction. The second extending portion 128B of the second contact 105B has a lower end continuous with the projecting portion 127B, and extends linearly in one direction intersecting the approaching direction. The second extending portions 128A and 128B in this embodiment extend linearly in the upward direction perpendicular to the mounting surface portion 111.

Positions of the lower ends of the second extending portion 128A and the second extending portion 128B in the up-and-down direction are different from each other. In this embodiment, the lower end of the second extending portion 128A is located below the lower end of the projecting portion 127B.

As described above, the upper end of the first extending portion 126B is located above the upper end of the projecting portion 127A, and the lower end of the second extending portion 128A is located below the lower end of the projecting portion 127B. With this, the positions of the projecting portion 127A and the projecting portion 127B in the up-and-down direction are different from each other so that the projecting portion 127A and the projecting portion 127B are prevented from overlapping each other in the up-and-down direction. Here, the up-and-down direction is an example of a direction intersecting the approaching direction.

Further, the positions of the projecting portion 127A and the projecting portion 127B in the up-and-down direction are different from each other. Accordingly, even when the projecting portion 127A and the projecting portion 127B project to such a large degree as to include the overlapping portions as viewed from above as described above, the projecting portion 127A and the projecting portion 127B can be prevented from coming into contact with each other. With this, the projecting portion 127A and the projecting portion 127B can be projected to a large degree in the approaching direction while preventing a short circuit between the first contact 105A and the second contact 105B.

The inflecting portions 129A and 129B are each a portion that bends in an extending direction of the second held portion 124A or the second held portion 124B, and has one end continuous with another end of the second extending portion 128A or the second extending portion 128B, and another end continuous with of the second held portion 124A or the second held portion 124B.

Specifically, the inflecting portion 129A of the first contact 105A bends forward, and has a lower end continuous with the upper end of the second extending portion 128A, and another end continuous with the rear end of the second held portion 124A. The inflecting portion 129B of the second contact 105B bends forward, and has a lower end continuous with the upper end of the second extending portion 128B, and another end continuous with the rear end of the second held portion 124B.

The configuration of the connector 100 according to one embodiment of this invention is described above. Now, an example of a method of manufacturing the connector 100 according to this embodiment is described.

The stationary housing 102, the movable housing 103, the right-side and left-side fixtures 104, and the plurality of pairs of the first contact 105A and the second contact 105B are prepared.

The first held portions 123A of the plurality of first contacts 105A are respectively press-fitted into the plurality of first groove portions 112A formed in the front-side plate-shaped portion 109A of the stationary housing 102. In this manner, the plurality of first contacts 105A are fixed to the stationary housing 102. Herein, the press-fitting means an operation of pushing in while applying a force.

The first held portions 123B of the plurality of second contacts 105B are respectively press-fitted into the plurality of first groove portions 112B formed in the rear-side plate-shaped portion 109B of the stationary housing 102. In this manner, as well as the plurality of first contacts 105A, the plurality of second contacts 105B are fixed to the stationary housing 102.

The second held portions 124A of the plurality of first contacts 105A are respectively press-fitted into the lower-side second groove portions 116A and the lower-side hole portions 117A that are formed in the movable housing 103 and communicate with each other. At the same time, the second held portions 124B of the plurality of second contacts 105B are respectively press-fitted into the upper-side second groove portions 116B and the upper-side hole portions 117B that are formed in the movable housing 103 and communicate with each other.

At this time, the right-side and left-side guided portions 114 are mounted to the stationary housing 102 so as to be located between the right-side and left-side fixed portions 106 in the right-and-left direction. Further, the position of the movable housing 103 relative to the stationary housing 102 is adjusted so that the right-side and left-side guided portions 114 are respectively fitted in the clearance between the right-side front extending portion 107 and the right-side rear extending portion 108 and the clearance between the left-side front extending portion 107 and the left-side rear extending portion 108 in the front-and-rear direction.

In this manner, the plurality of pairs of the first contact 105A and the second contact 105B are fixed to the stationary housing 102 and the movable housing 103.

The right-side and left-side fixtures 104 are respectively press-fitted into the through-holes 110 formed in the right-side and left-side fixed portions 106. At this time, it is preferred that the stopping portion 119 of each of the fixtures 104 be pushed in up to a position at a predetermined distance from the upper surface of the cutout portion of the tubular portion 113 of the movable housing 103.

In this manner, the connector 100 is brought into completion.

In the connector 100 according to this embodiment, the first held portions 123A and 123B of the pair of the first contact 105A and the second contact 105B are fixed to the stationary housing 102. Further, the second held portions 124A and 124B of the pair of the first contact 105A and the second contact 105B are fixed to the movable housing 103. The elastic deformation portion 125A couples the first held portion 123A and the second held portion 124A, and the elastic deformation portion 125B couples the first held portion 123B and the second held portion 124B. Accordingly, when the elastic deformation portions 125A and 125B are elastically deformed, a position of the movable housing 103 relative to the stationary housing 102 can be shifted. In other words, at the time of fitting to the mating connector, in accordance with a position of the fitting portion of the mating connector, positions of the first contact 105A and the second contact 105B arranged in the fitting portion 115 can be shifted. Therefore, the connector 100 according to this embodiment is a floating connector.

In a case of this configuration, the floating amount is restricted within a range in which the elastic deformation portions 125A and 125B are not plastically deformed, in other words, a range in which the elastic deformation portions 125A and 125B can be elastically deformed. The floating amount means an amount by which a position of the fitting portion 115 of the movable housing 103 can be shifted relative to the stationary housing 102.

In the connector 100 according to this embodiment, the elastic deformation portions 125A and 125B respectively include the projecting portions 127A and 127B projecting in the approaching directions. As illustrated in FIG. 6, the projecting portions 127A and 127B have open spaces ORA and ORB, respectively. The open spaces ORA and ORB are each an open interval formed between both ends of the projecting portion 127A or the projecting portion 127B.

Accordingly, when forces are applied to the first contact 105A and the second contact 105B during shifting of the position of the fitting portion 115 of the movable housing 103, the elastic deformation portions 125A and 125B can be deformed while changing widths of the open intervals ORA and ORB. With this, as compared to related-art contacts having no projecting portions 127A and 127B, the first contact 105A and the second contact 105B can be elastically deformed to a large extent without involving an increase in size. Therefore, the floating amount can be increased while preventing an increase in entire size of the connector 100.

The projecting portions 127A and 127B in this embodiment project in the approaching directions. With this, as compared to a case in which one of or both of the projecting portions 127A and 127B project in the separating directions, the first contact 105A and the second contact 105B can be elastically deformed to a large extent without involving an increase in size in the front-and-rear direction. Therefore, the floating amount can be increased while preventing the increase in entire size of the connector 100.

The positions of the projecting portions 127A and 127B in the up-and-down direction in this embodiment are different from each other. With this, it is possible to reduce a risk in that the projecting portions 127A and 127B come into contact with each other during, for example, deformation when the projecting portions 127A and 127B are arranged close to each other. Therefore, the connector 100 with higher reliability can be provided.

The projecting portions 127A and 127B in this embodiment include the overlapping portions as viewed from above. With this, without increasing an interval between the first contact 105A and the second contact 105B in the front-and-rear direction, the projecting amounts of the projecting portions 127A and 127B can be increased. Thus, without being plastically deformed, the elastic deformation portions 125A and 125B can be deformed while changing the widths of the open spaces ORA and ORB to a large extent. Therefore, the floating amount can be further increased while preventing the increase in entire size of the connector 100.

The elastic deformation portion 125A in this embodiment includes, in addition to the projecting portion 127A, the first extending portion 126A and the second extending portion 128A described above. The elastic deformation portion 125B in this embodiment includes, in addition to the projecting portion 127B, the first extending portion 126B and the second extending portion 128B described above. Further, the projecting portion 127A includes the first bending portion 130A, the first arm portion 131A, the second bending portion 132A, the coupling portion 133A, the third bending portion 134A, the second arm portion 135A, and the fourth bending portion 136A. The projecting portion 127B includes the first bending portion 130B, the first arm portion 131B, the second bending portion 132B, the coupling portion 133B, the third bending portion 134B, the second arm portion 135B, and the fourth bending portion 136B. With such a relatively simple configuration, the projecting portions 127A and 127B projecting in the approaching directions can be formed in the first contact 105A and the second contact 105B, respectively. Therefore, the floating amount can be increased while preventing the increase in entire size of the connector 100 with a simple configuration.

The first extending portions 126A and 126B and the second extending portions 128A and 128B in this embodiment extend in a direction perpendicular to the mounting surface portion 111. With this, the projecting portion 127A can be formed in the first contact 105A with a more compact configuration than in a case in which the first extending portion 126A and the second extending portion 128A are inclined forward. Further, the projecting portion 127B can be formed in the second contact 105B with a more compact configuration than in, for example, a case in which the first extending portion 126B and the second extending portion 128B are inclined rearward. Therefore, the floating amount can be increased while preventing the increase in entire size of the connector 100.

Each of the projecting portions 127A and 127B in this embodiment projects in the approaching direction, and the approaching direction is parallel to the mounting surface portion 111. With this, the projecting portions 127A and 127B can be formed in the first contact 105A and the second contact 105B, respectively, with a simpler configuration than in a case in which the projecting portions 127A and 127B are inclined with respect to the mounting surface portion 111. Therefore, the floating amount can be increased while preventing the increase in entire size of the connector 100 with a simple configuration.

The fitting portion 115 in this embodiment is fitted to the mating connector by being inserted into the mating connector along a direction parallel to the mounting surface portion 111. With this, in a type of the floating connector, which is fitted to the mating connector along the direction parallel to the mounting surface portion 111, as described above, the floating amount can be increased while preventing the increase in entire size of the connector 100.

One embodiment of this invention is described above, but this embodiment may be modified as follows.

For example, it is only required that the elastic deformation portion of each of the pair of the first contact and the second contact include the projecting portion projecting in the approaching direction or the separating direction. Such an elastic deformation portion is not limited to the elastic deformation portions 125A and 125B in the above-mentioned embodiment.

Figure 7A:
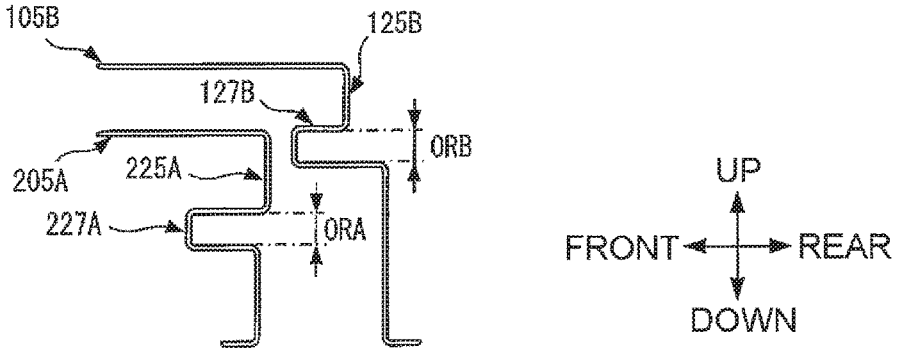
FIG. 7A, FIG. 7B, and FIG. 7C are views for illustrating examples in which one of or both of an elastic deformation portion of a first contact and an elastic deformation portion of a second contact include a projecting portion projecting in a separating direction.
Figure 7B:
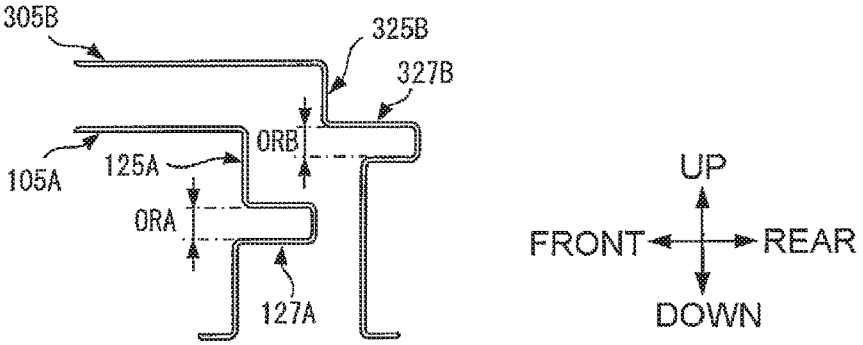

As illustrated in FIG. 7A, an elastic deformation portion 225A of a first contact 205A may include a projecting portion 227A projecting in the separating direction. Further, as illustrated in FIG. 7B, an elastic deformation portion 325B of a second contact 305B may include a projecting portion 327B projecting in the separating direction. Still further, as illustrated in FIG. 7C, the elastic deformation portion 225A of the first contact 205A and the elastic deformation portion 325B of the second contact 305B may respectively include the projecting portion 227A and the projecting portion 327B projecting in the separating directions.

Figure 7C:
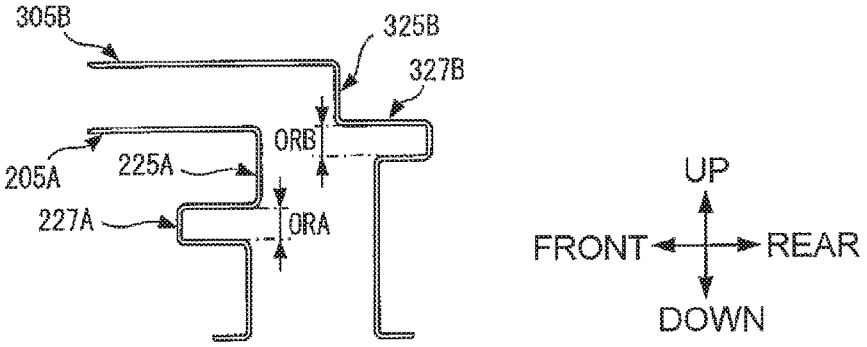

The first contact 205A and the second contact 305B illustrated in FIG. 7A to FIG. 7C respectively have the same configurations as those of the first contact 105A and the second contact 105B exclusive of the above-mentioned points.

As illustrated in FIG. 7A, the first contact 205A is paired with the second contact 105B, and is held by, for example, the same stationary housing 102 and the same movable housing 103 in the embodiment, thereby being capable of forming the connector. Further, as illustrated in FIG. 7B, the second contact 305B is paired with the first contact 105A, and is held by, for example, the same stationary housing 102 and the same movable housing 103 in the embodiment, thereby being capable of forming the connector. Still further, as illustrated in FIG. 7C, the second contact 305B is paired with the first contact 205A, and is held by, for example, the same stationary housing 102 and the same movable housing 103 in the embodiment, thereby being capable of forming the connector.

In those modification examples, the elastic deformation portions 225A and 325B respectively include the projecting portions 227A and 327B projecting in the separating directions. Similarly to the projecting portions 127A and 127B in the embodiment, as illustrated in FIG. 7A to FIG. 7C, the projecting portions 227A and 327B have the open spaces ORA and ORB, respectively. The open spaces ORA and ORB are each an open interval formed between both ends of the projecting portion 227A or the projecting portion 327B.

Accordingly, when a force is applied to the first contact 205A during shifting of the position of the fitting portion 115 of the movable housing 103, similarly to the elastic deformation portion 125A in the embodiment, the elastic deformation portion 225A can be deformed while changing the width of the open interval ORA. Further, similarly to the elastic deformation portion 125B in the embodiment, the elastic deformation portion 325B can be deformed while changing the width of the open interval ORB.

With this, as compared to related-art contacts having no projecting portions 227A and 327B, the first contact 205A and the second contact 305B can be elastically deformed to a large extent without involving an increase in size. That is, as compared to a related-art contact having the same size, each of the first contact 205A and the second contact 305B can achieve a larger floating amount. Therefore, the floating amount can be increased while preventing the increase in entire size of the connector 100.

Further, in those modification examples, in addition to the above-mentioned effect, the same effects as those of the embodiment can be obtained exclusive of the effect associated with a configuration in which both the projecting portions 127A and 127B project in the approaching directions.

That is, each of the projecting portions 227A and 327B in those modification examples projects in the separating direction, and the separating direction is parallel to the mounting surface portion 111. Therefore, similarly to the embodiment, the floating amount can be increased while preventing an increase in entire size of the connector 100 with a simple configuration.

Further, even in those modification examples, the fitting portion 115 can be fitted to the mating connector by being inserted into the mating connector in the direction parallel to the mounting surface portion 111. Therefore, similarly to the embodiment, in a type of the floating connector, which is fitted to the mating connector in the direction parallel to the mounting surface portion 111, the floating amount can be increased while preventing the increase in entire size of the connector 100.

Further, in the embodiment, description is made of the example in which the projecting portions 127A and 127B each have a rectangular shape. The shapes of the projecting portions 127A and 127B may be changed as appropriate.

Figure 8A:
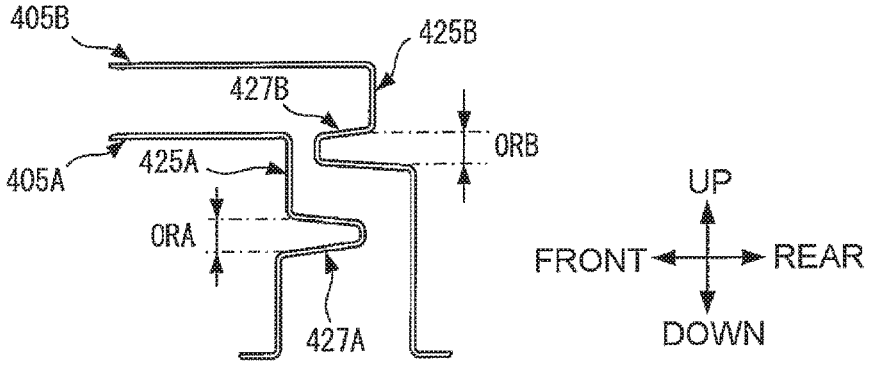
FIG. 8A and FIG. 8B are views for illustrating modification examples of shapes of the projecting portions.

For example, as illustrated in FIG. 8A, a projecting portion 427A and a projecting portion 427B may each have a trapezoid shape. The projecting portion 427A of an elastic deformation portion 425A of a first contact 405A has a trapezoid shape gradually reduced in width in the up-and-down direction to the rear side. The projecting portion 427B of an elastic deformation portion 425B of a second contact 405B has a trapezoid shape gradually reduced in width in the up-and-down direction to the front side.

Figure 8B:
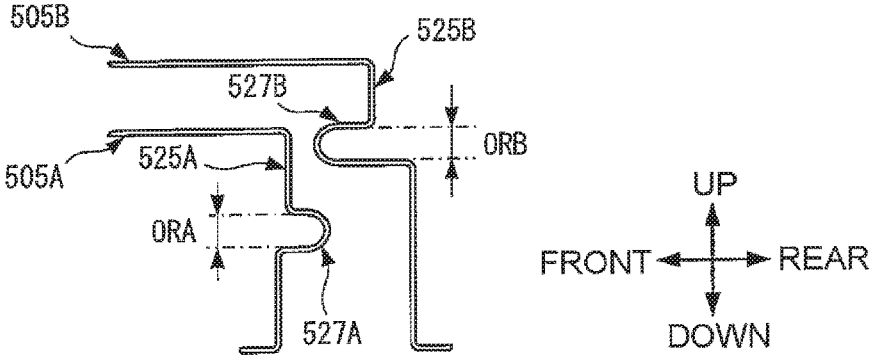
Figure 9:
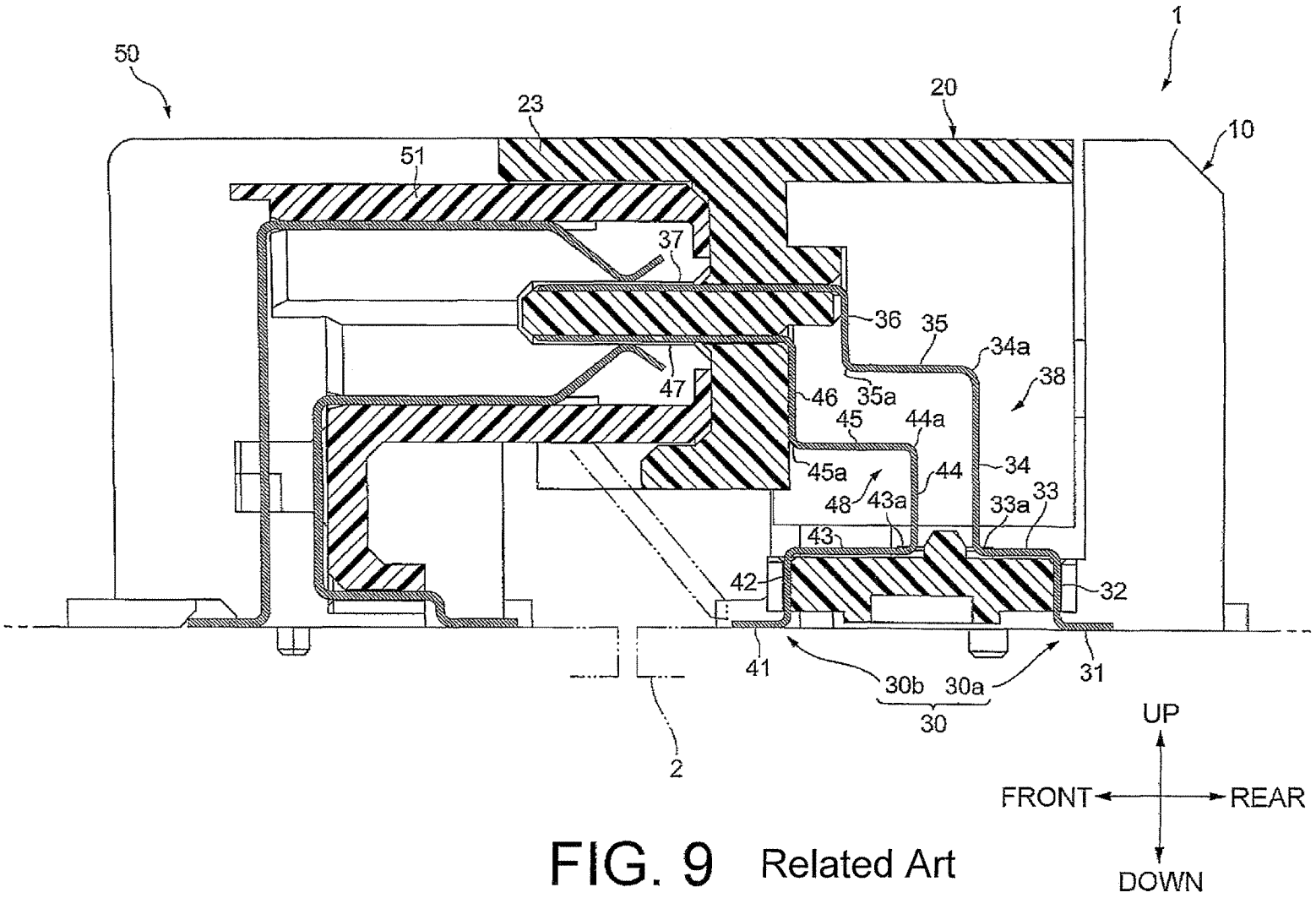
FIG. 9 Related Art
FIG. 9 is a view for illustrating a configuration of a connector of the related art.

Further, for example, as illustrated in FIG. 8B, a projecting portion 527A and a projecting portion 527B may be curved. The projecting portion 527A of an elastic deformation portion 525A of a first contact 505A includes substantially a semicircular portion. Similarly, the projecting portion 527B of an elastic deformation portion 525B of a second contact 505B also includes substantially a semicircular portion.

The first contacts 405A and 505A and the second contacts 405B and 505B illustrated in FIG. 8A and FIG. 8B have configurations similar to the first contact 105A and the second contact 105B exclusive of the above-mentioned points.

Also in those modification examples, the same effects as those of the embodiment are obtained.

In the above, the embodiments and the modification examples of this invention are described. However, this invention is not limited to those embodiments and modification examples. For example, this invention may include a mode in which the embodiments and the modification examples described above are partially or entirely combined in a suitable manner or a mode suitably changed from the mode of combination.

What is claimed is:

1. A connector, comprising:

a stationary housing to be mounted to a connection object;

a movable housing configured to move relative to the stationary housing; and at least one pair of contacts arranged apart from each other in a common plane so as to correspond to each other, each of the at least one pair of contacts including:

a first held portion fixed to the stationary housing;

a second held portion fixed to the movable housing; and an elastic deformation portion configured to couple the first held portion and the second held portion, the elastic deformation portion of the each of the at least one pair of contacts including a projecting portion that projects in an approaching direction, which is a direction of approaching the elastic deformation portion of another contact of the at least one pair of contacts, or in a separating direction, which is a direction opposite to the approaching direction.

2. The connector according to claim 1, wherein the projecting portion of the each of the at least one pair of contacts is configured to project in the approaching direction.

3. The connector according to claim 2, wherein the projecting portions of the at least one pair of contacts are arranged at different positions in a direction intersecting the approaching direction.

4. The connector according to claim 3, wherein the projecting portions of the at least one pair of contacts include overlapping portions as viewed in one direction intersecting the approaching direction.

5. The connector according to claim 2, wherein the elastic deformation portion of each of the at least one pair of contacts further includes:

a first extending portion, which extends linearly and has one end continuous with the first held portion, and another end continuous with one end of the projecting portion; and a second extending portion, which has one end continuous with another end of the projecting portion, and extends in one direction intersecting the approaching direction, and wherein the projecting portion includes:

a first bending portion, which has one end continuous with the another end of the first extending portion, and bends in the approaching direction;

a first arm portion, which has one end continuous with another end of the first bending portion, and extends in the approaching direction;

a second bending portion, which has one end continuous with another end of the first arm portion, and bends in one direction intersecting the approaching direction;

a coupling portion, which has one end continuous with another end of the second bending portion, and extends in one direction intersecting the approaching direction;

a third bending portion, which has one end continuous with another end of the coupling portion, and bends in the separating direction;

a second arm portion, which has one end continuous with another end of the third bending portion, and extends in the separating direction; and a fourth bending portion, which bends in one direction intersecting the approaching direction, and has one end continuous with another end of the second arm portion, and another end continuous with the one end of the second extending portion.

6. The connector according to claim 5, wherein the stationary housing includes a mounting surface portion to be mounted to the connection object, and wherein the first extending portion and the second extending portion each extending in a direction perpendicular to the mounting surface portion.

7. The A connector according to claim 6, wherein the movable housing includes a fitting portion fitted to a mating connector by being inserted into the mating connector along a direction parallel to the mounting surface portion.

8. The connector according to claim 1, wherein the stationary housing includes a mounting surface portion to be mounted to the connection object, and wherein the approaching direction and the separating direction are parallel to the mounting surface portion.

9. The connector according to claim 8, wherein the movable housing includes a fitting portion fitted to a mating connector by being inserted into the mating connector along a direction parallel to the mounting surface portion.

* * * * *